US007644455B2

(12) United States Patent
Chang

(10) Patent No.: US 7,644,455 B2
(45) Date of Patent: Jan. 12, 2010

(54) ADJUSTABLE BED FRAME

(76) Inventor: Min-Chia Chang, No. 688, Chong Cheng S. Road, Yung Kang City, Tainan Hsien (TW)

( * ) Notice: Subject to any disclaimer, the term of this patent is extended or adjusted under 35 U.S.C. 154(b) by 508 days.

(21) Appl. No.: 11/669,147

(22) Filed: Jan. 30, 2007

(65) Prior Publication Data

US 2008/0178385 A1 Jul. 31, 2008

(51) Int. Cl.
*A47C 19/04* (2006.01)

(52) U.S. Cl. ..... 5/181; 5/411

(58) Field of Classification Search ..... 5/181, 5/183–185, 411
See application file for complete search history.

(56) References Cited

U.S. PATENT DOCUMENTS 402,129 A * 4/1889 Beckert ..... 5/183
585,846 A * 7/1897 Kean ..... 5/183
1,080,577 A * 12/1913 Pascale et al. ..... 5/114
1,259,022 A * 3/1918 Kean et al. ..... 5/183
1,306,614 A * 6/1919 Novick ..... 5/100
1,493,104 A * 5/1924 Carrigan ..... 5/112
2,595,321 A * 5/1952 Anderson ..... 5/238
2,960,701 A * 11/1960 Nawara ..... 5/181
4,679,261 A * 7/1987 Stanley et al. ..... 5/183
2008/0178385 A1* 7/2008 Chang ..... 5/181

* cited by examiner

*Primary Examiner*—Robert G Santos
(74) *Attorney, Agent, or Firm*—WPAT, P.C.; Anthony King; Kay Yang

(57) ABSTRACT

An adjustable bed frame includes a frame having a first retractable device in a horizontal direction for securing a first supporting unit. The first supporting unit includes a second retractable device for securing a first mattress. Second supporting units are provided at respective sides of the frame. Each second supporting unit has a third retractable device therein for securing a second mattress. The first mattress is connected with a soft pad. The second mattress is connected with a soft pad. The first supporting unit can be pulled outward in a horizontal direction. Both the first mattress and the second mattress can be lifted upward, and the soft pads can be turned for different purposes.

20 Claims, 7 Drawing Sheets

ADJUSTABLE BED FRAME

BACKGROUND OF THE INVENTION

1. Field of the Invention

The present invention relates to an adjustable bed, in particular to a bed frame with a first supporting unit movable along horizontally and two mattresses movable along vertically as well as a rotatable soft pad.

2. Description of the Prior Art

Most beds on market have a fixed size, and are not changeable, therefore it can not fit a user with different height. In order to protect a baby from rolling down from the bed, people normally put railings at the edge, which is not convenient for the user.

SUMMARY OF THE INVENTION

In order to solve the above mentioned problems and many others, an adjustable bed frame is derived. According to the present invention, there is provided an adjustable bed frame comprising a frame having a first retractable device secured horizontally therein; a first supporting unit secured to said first retractable device of said frame, a second retractable device being provided in said first supporting unit in a vertical direction; a first mattress secured to said second retractable device; second supporting units secured to respective sides of said frame, a third retractable device being provided in each said second supporting unit in a vertical direction; and a second mattress secured to said third retractable device.

It is another object of the present invention to provide an adjustable bed frame, which can be adjusted with its length horizontally so that people of different height may be fit on.

It is still another object of the present invention to provide an adjustable bed frame, which is able to adjust the height of the bed end to lift up the user's foot.

It is a further object of the present invention to provide an adjustable bed frame, which can turn the first mattress and the second mattress towards two different directions to lift up the bed at different directions for special purposes.

It is still a further object of the present invention to provide an adjustable bed frame, which can enlarge its size when the second mattress remains unchanged so that user can have a wider sized bed to sleep comfortable.

It is still another object of the present invention to provide an adjustable bed frame, which can guard toddlers from rolling down when the second mattress is raised up.

It is still another object of the present invention to provide an adjustable bed frame, which can prevent a quilt from dropping off the bed.

It is still another object of the present invention to provide an adjustable bed frame, which prevents the mattress from sliding randomly.

It is still another object of the present invention to provide an adjustable bed frame, which has the first retractable device, the second retractable device, and the third retractable device to be mounted in the slots of the supporting seat, so as to provide a support force when sliding and to provide a locating capability.

DETAILED DESCRIPTION OF THE PREFERRED EMBODIMENT

Figure 1:
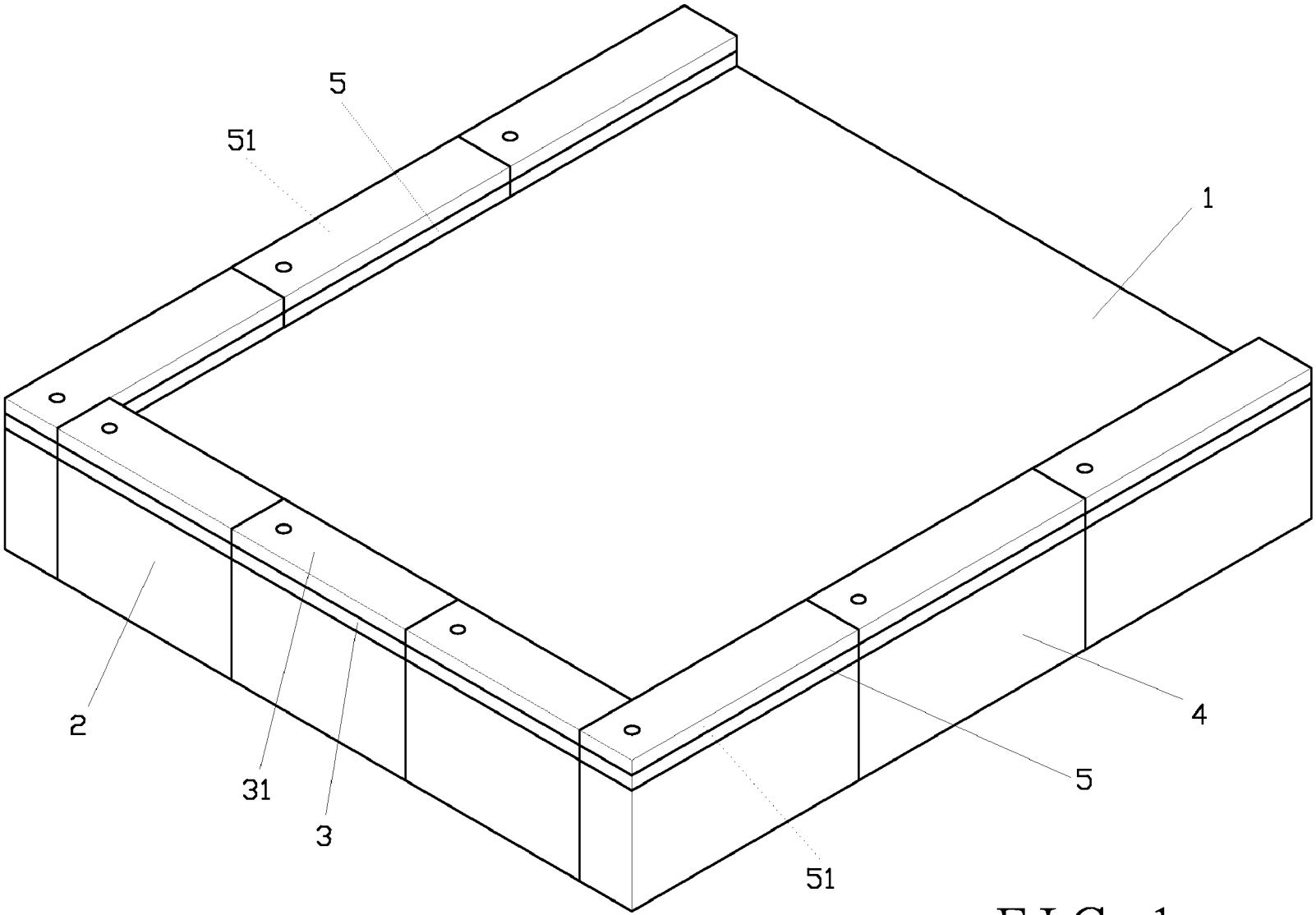
FIG. 1 is a perspective view of the present invention.
Figure 2:
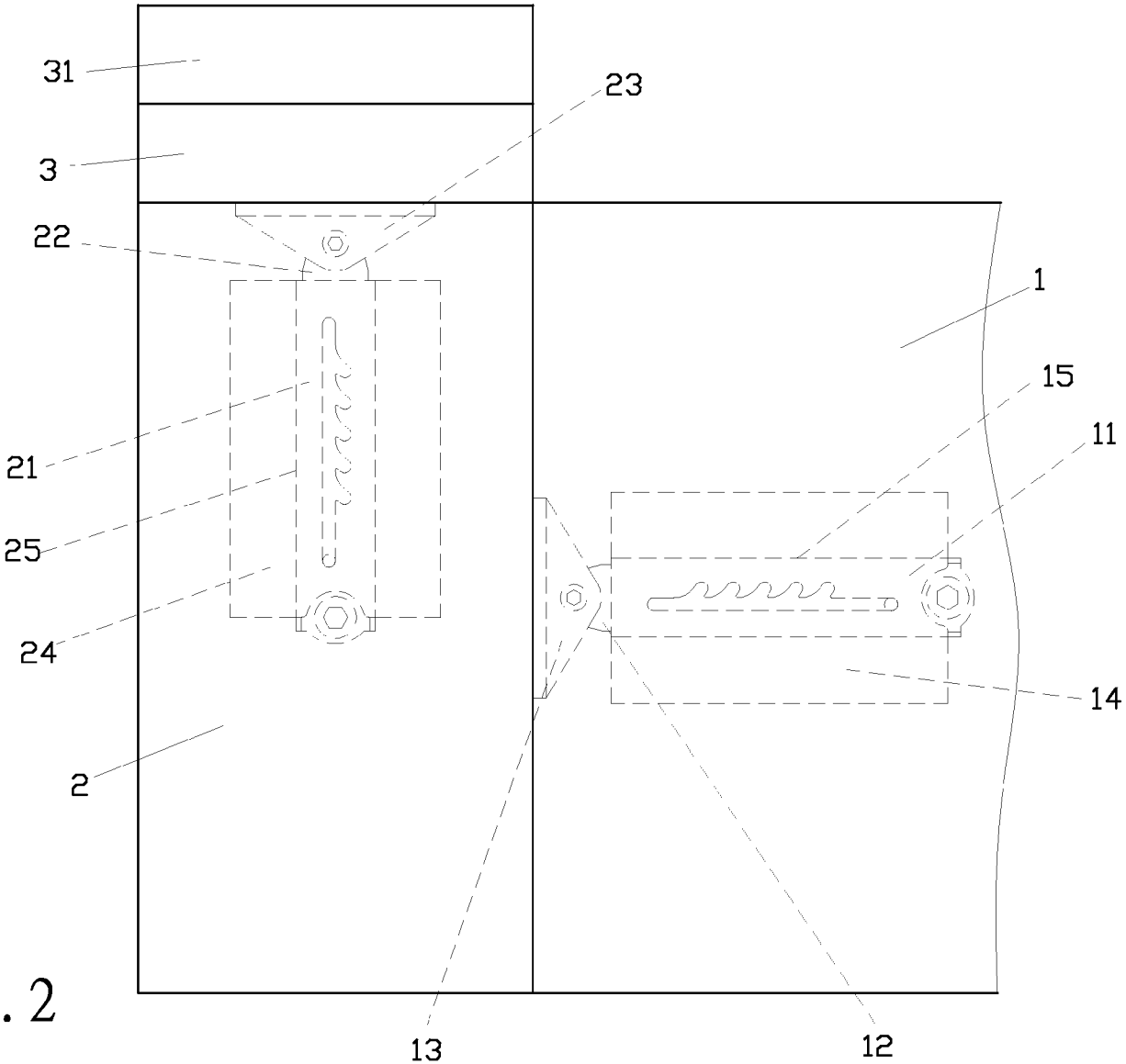
FIG. 2 is a side view showing a first supporting unit and a first mattress of the present invention.
Figure 3:
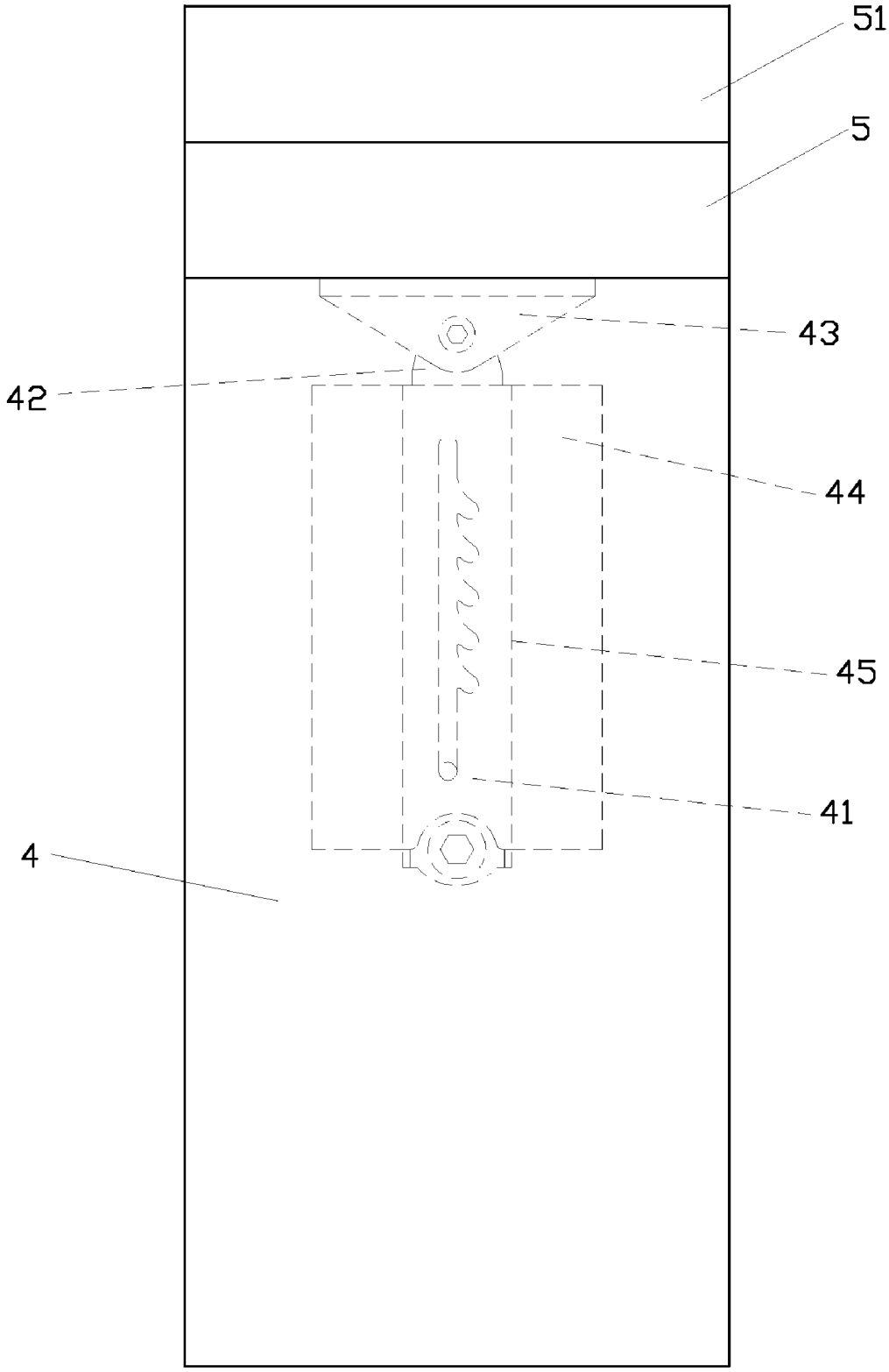
FIG. 3 is a side view showing a second supporting unit and a second mattress of the present invention.

As shown in FIGS. 1, 2 and 3, a preferred embodiment of the present invention comprises a frame 1, a first supporting unit 2, a first mattress 3, second supporting units 4, and a second mattress 5.

The frame 1 comprises a number of first retractable devices 11 at the endmost inner of the frame 1 in a horizontal direction. The first retractable device 11 has a retractable rod 12 enable to move horizontally. One end of the retractable rod 12 is pivotally connected with a rotatable seat 13 which is able to rotate at 180 degrees. A supporting seat 14 is provided at the endmost inner of the frame 1. The supporting seat 14 has a horizontal slot 15 for the first retractable device 11 to be secured therein for supporting and locating purposes.

The first supporting unit 2 is secured to the rotatable seat 13 of the frame 1 for horizontal movement. A second retractable device 21 is vertically provided in the first supporting unit 2. The second retractable device 21 has a retractable rod 22 enable to move vertically. One end of the retractable rod 22 is pivotally connected with a rotatable seat 23 which is able to rotate at 180 degrees. A supporting seat 24 is provided in the first supporting unit 2. The supporting seat 24 has a vertical slot 25 for the second retractable device 21 to be secured therein for supporting and locating purposes.

The first mattress 3 is secured to the rotatable seat 23 of the second retractable device 21 for moving in a vertical direction. The first mattress 3 is pivotally connected with a soft pad 31 which is able to turn in either right or left direction.

The second supporting units 4 are formed independently from each other and mounted at respective sides of the frame 1 by means of screwed connection or inserting connection. A number of third retractable devices 41 are vertically provided in the second supporting units 4. Each third retractable device 41 has a third retractable rod 42 enable to move vertically. One end of the retractable rod 42 is pivotally connected with a rotatable seat 43 which is able to rotate at 180 degrees. A supporting seat 44 is provided in each second supporting unit 4. The supporting seat 44 has a vertical slot 45 for the third retractable device 41 to be secured therein for supporting and locating purposes.

The second mattress 5 is secured to the rotatable seat 43 of the third retractable device 41 for moving in a vertical direction. The second mattress 5 is pivotally connected with a soft pad 51 which is able to turn in left or right direction.

Figure 4:
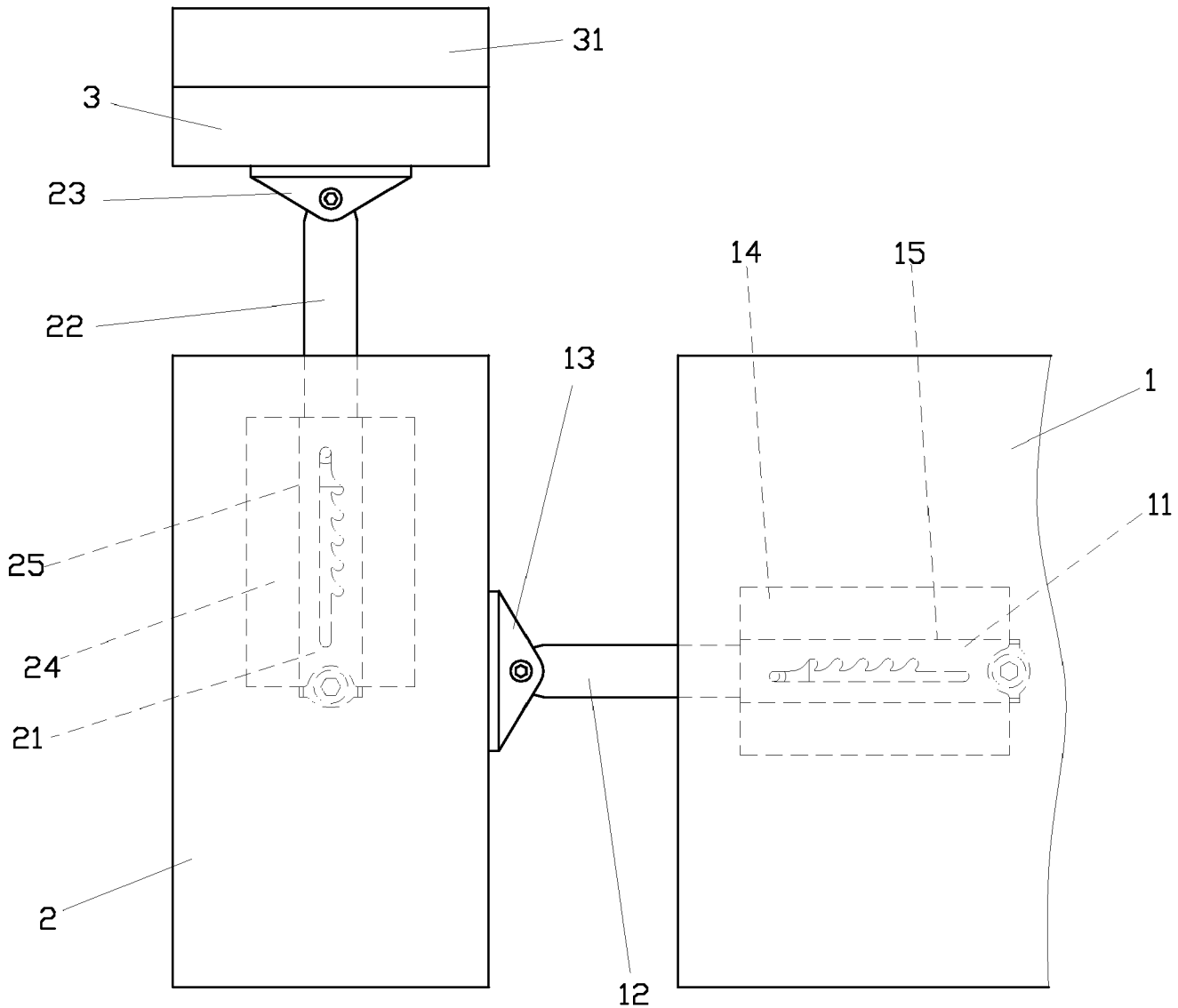
FIG. 4 is a side view of the present invention showing that the first supporting unit is pulled outward horizontally and the first mattress is lifted vertically.
Figure 7:
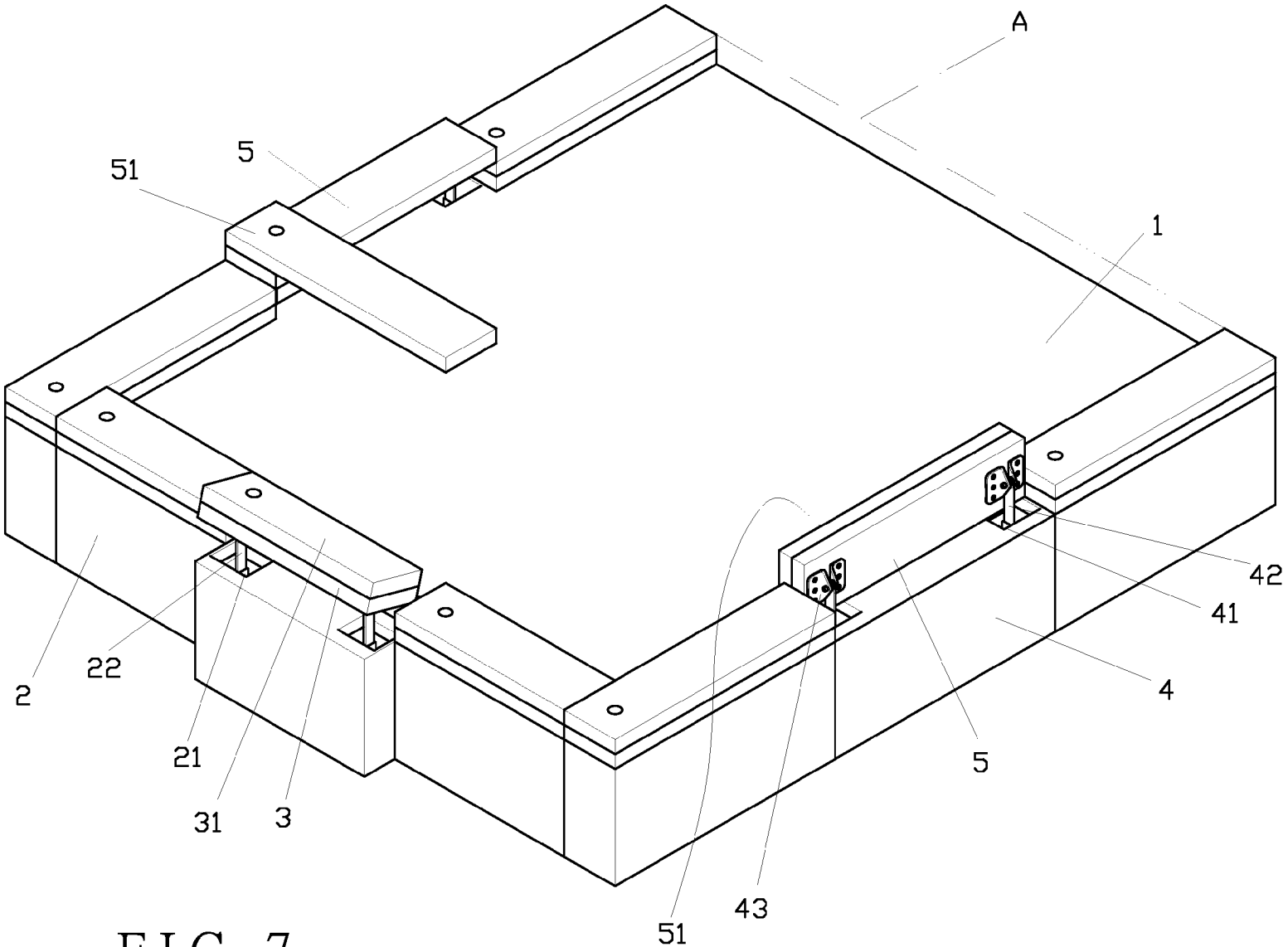
FIG. 7 is a perspective view of the present invention in use.

To operate the present invention, as shown in FIG. 7, a mattress A is placed on the frame 1 with the same flatness of the first mattress 3 and the second mattress 5 for the user to lie down comfortably. When it is necessary to add up the length of the bed for a taller user, the first supporting unit 2 is pulled outward in a horizontal direction, as shown in FIGS. 2 and 4. The rotatable seat 13 will pull the first retractable rod 12 of the first retractable device 11 simultaneously to extend the length of the frame 1.

To lift the end of the frame 1, the first mattress 3 on the first supporting unit 2 is pulled upwardly. The first mattress 3 connected to the rotatable seat 23 of the second retractable rod 22 of the second retractable device 21 will be lifted vertically, and it may vary the direction by turning the soft pad 31 of the first mattress 3. Rotation of the rotatable seat 23 of the retractable rod 22 of the second retractable device 21 may direct the first mattress 3 towards different directions.

Figure 5:
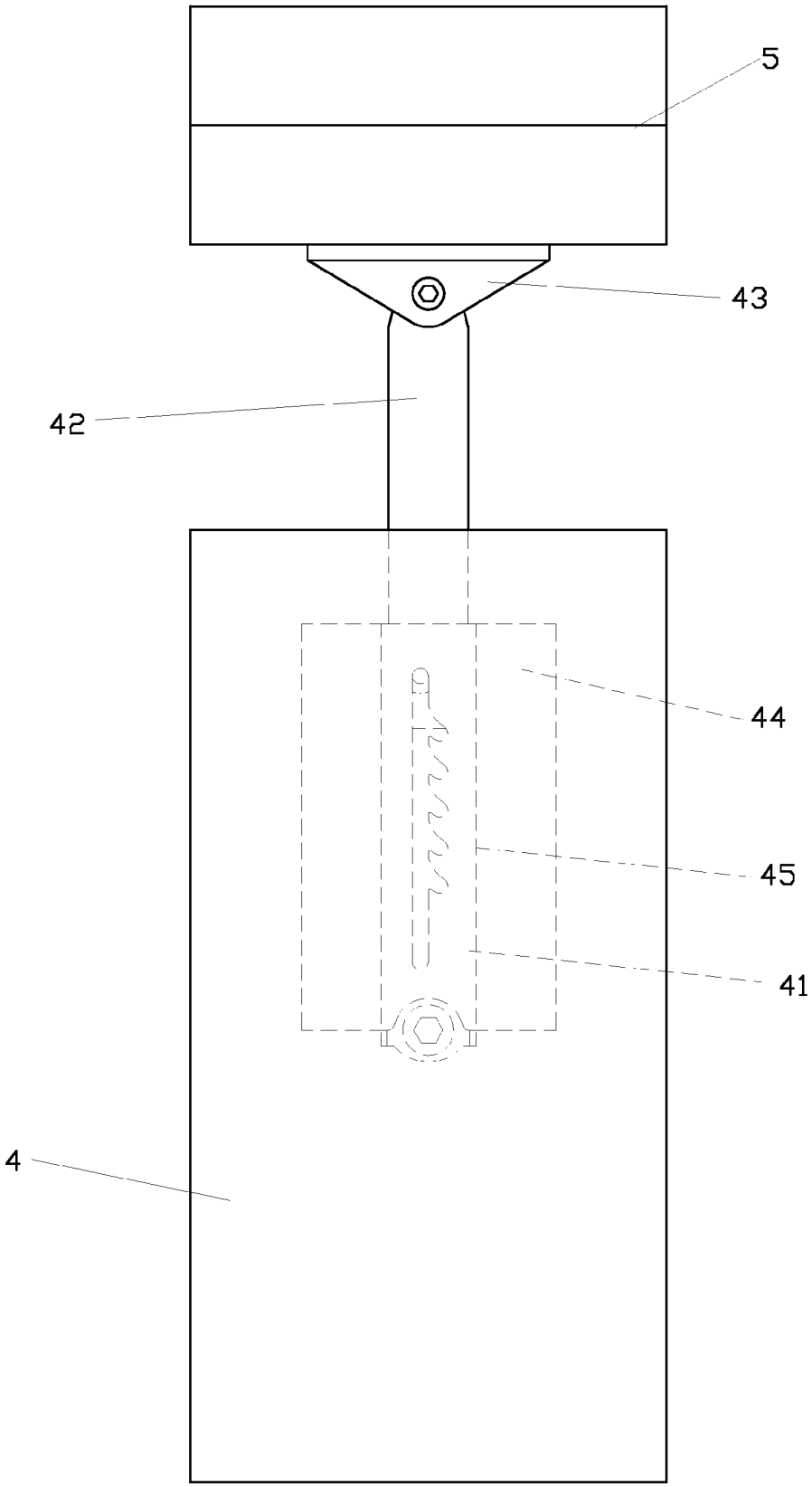
FIG. 5 is a side view of the present invention showing that the second mattress on the second supporting unit is lifted vertically.
Figure 6:
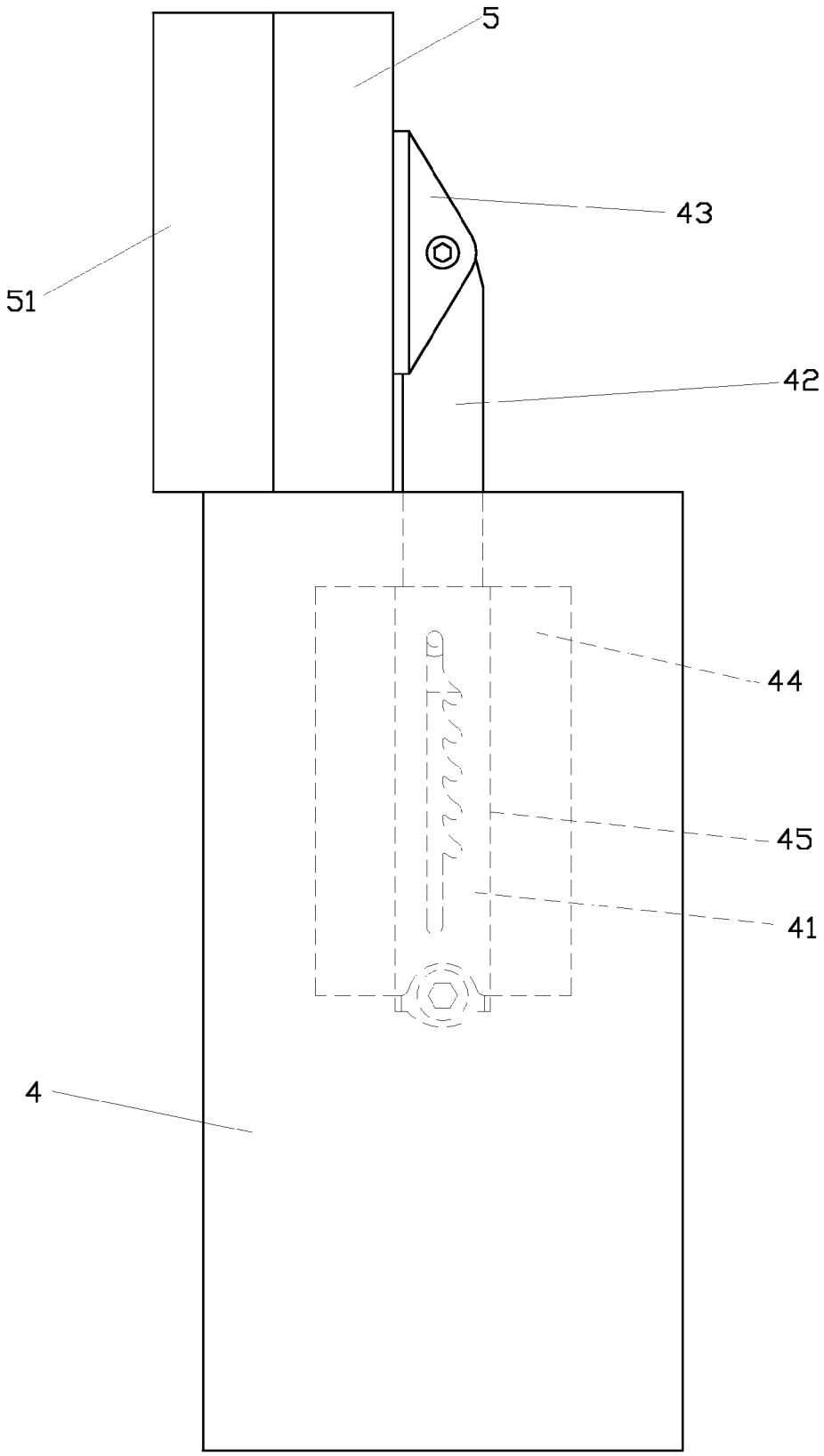
FIG. 6 is a side view of the present invention showing that the second mattress on the second supporting unit is turned.

When the second mattresses 5 at respective sides of the frame 1 are in unchanged positions, the bed can accommodate more people on the bed. When the bed is used for toddlers, as shown in FIG. 5, the two sides of the frame 1 need to be raised up to protect children from falling. The second mattress 5 on the second supporting unit 4 is pulled upwardly. The second mattress 5 secured to the rotatable seat 43 of the retractable rod 42 of the third retractable device 41 of the second supporting unit 4 is to be raised a certain height with respect to the frame 1. The soft pad 31 of the first mattress 3 may be turned to form a pad for leaning purpose. Rotation of the rotatable seat 43 of the retractable rod 42 of the third retractable device 41, as shown in FIG. 6, may change the direction of the second mattress 5 for different purposes.

What is claimed is:

1. An adjustable bed frame, comprising:

a frame having a first retractable device secured horizontally therein;

a first supporting unit secured to said first retractable device of said frame, a second retractable device being provided in said first supporting unit in a vertical direction;

a first mattress secured to said second retractable device;

second supporting units secured to respective sides of said frame, a third retractable device being provided in each said second supporting unit in a vertical direction; and a second mattress secured to said third retractable device, wherein said first retractable device comprises a retractable rod, said retractable rod having one end pivotally connected with a rotatable seat for said first supporting unit to be secured thereat.

2. The adjustable bed frame, as recited in claim 1, wherein said frame comprises a supporting seat therein, said supporting seat having a horizontal slot for said first retractable device to be secured therein.

3. The adjustable bed frame, as recited in claim 1, wherein said first supporting unit comprises a supporting seat therein, said supporting seat having a vertical slot for said second retractable device to be secured therein.

4. The adjustable bed frame, as recited in claim 1, wherein said second retractable device comprises a retractable rod, said retractable rod having one end pivotally connected with a rotatable seat for said first mattress to be secured thereat.

5. The adjustable bed frame, as recited in claim 1, wherein said second supporting unit comprises a supporting seat therein, said supporting seat having a vertical slot for said third retractable device to be secured therein.

6. The adjustable bed frame, as recited in claim 1, wherein said third retractable device comprises a retractable rod, said retractable rod having one end pivotally connected with a rotatable seat for said second mattress to be secured thereat.

7. The adjustable bed frame, as recited in claim 1, wherein said first retractable device is disposed at an endmost end of said frame.

8. The adjustable bed frame, as recited in claim 1, wherein said first mattress comprises a soft pad thereon.

9. The adjustable bed frame, as recited in claim 1, wherein said second mattress comprises a soft pad thereon.

10. An adjustable bed frame, comprising:

a frame having a first retractable device secured horizontally therein;

a first supporting unit secured to said first retractable device of said frame, a second retractable device being provided in said first supporting unit in a vertical direction;

a first mattress secured to said second retractable device;

second supporting units secured to respective sides of said frame, a third retractable device being provided in each said second supporting unit in a vertical direction; and a second mattress secured to said third retractable device;

wherein said second retractable device comprises a retractable rod, said retractable rod having one end pivotally connected with a rotatable seat for said first mattress to be secured thereat.

11. The adjustable bed frame, as recited in claim 10, wherein said frame comprises a supporting seat therein, said supporting seat having a horizontal slot for said first retractable device to be secured therein.

12. The adjustable bed frame, as recited in claim 10, wherein said first supporting unit comprises a supporting seat therein, said supporting seat having a vertical slot for said second retractable device to be secured therein.

13. The adjustable bed frame, as recited in claim 10, wherein said second supporting unit comprises a supporting seat therein, said supporting seat having a vertical slot for said third retractable device to be secured therein.

14. The adjustable bed frame, as recited in claim 10, wherein said first retractable device is disposed at an endmost end of said frame.

15. The adjustable bed frame, as recited in claim 10, wherein each of said first mattress and said second mattress comprises a soft pad thereon.

16. An adjustable bed frame, comprising:

a frame having a first retractable device secured horizontally therein;

a first supporting unit secured to said first retractable device of said frame, a second retractable device being provided in said first supporting unit in a vertical direction;

a first mattress secured to said second retractable device;

second supporting units secured to respective sides of said frame, a third retractable device being provided in each said second supporting unit in a vertical direction; and a second mattress secured to said third retractable device;

wherein said third retractable device comprises a retractable rod, said retractable rod having one end pivotally connected with a rotatable seat for said second mattress to be secured thereat.

17. The adjustable bed frame, as recited in claim 16, wherein said frame comprises a supporting seat therein, said supporting seat having a horizontal slot for said first retractable device to be secured therein and said first retractable device is disposed at an endmost end of said frame.

18. The adjustable bed frame, as recited in claim 16, wherein said first supporting unit comprises a supporting seat therein, said supporting seat having a vertical slot for said second retractable device to be secured therein.

19. The adjustable bed frame, as recited in claim 16, wherein said second supporting unit comprises a supporting seat therein, said supporting seat having a vertical slot for said third retractable device to be secured therein.

20. The adjustable bed frame, as recited in claim 16, wherein each of said first mattress and said second mattress comprises a soft pad thereon.

* * * * *